US008925476B2

(12) United States Patent
Cho

(10) Patent No.: US 8,925,476 B2
(45) Date of Patent: Jan. 6, 2015

(54) BUILT-IN GAS UNIT AND AQUATIC TRANSPORTATION EQUIPMENT INCLUDING THE SAME

(76) Inventor: Hyun Chul Cho, Seoul (KR)

( * ) Notice: Subject to any disclaimer, the term of this patent is extended or adjusted under 35 U.S.C. 154(b) by 461 days.

(21) Appl. No.: 13/003,082

(22) PCT Filed: Jul. 9, 2009

(86) PCT No.: PCT/KR2009/003770

§ 371 (c)(1),
(2), (4) Date: Jan. 7, 2011

(87) PCT Pub. No.: WO2010/005250

PCT Pub. Date: Jan. 14, 2010

(65) Prior Publication Data

US 2011/0155041 A1 Jun. 30, 2011

(30) Foreign Application Priority Data

Jul. 9, 2008 (KR) ..... 10-2008-0066724
Mar. 17, 2009 (KR) ..... 10-2009-0022788

(51) Int. Cl.
*B63B 7/08* (2006.01)

(52) U.S. Cl.
CPC ..... *B63B 7/082* (2013.01)
USPC ..... 114/345

(58) Field of Classification Search
CPC ..... B63B 7/00; B63B 7/08; B63B 7/082
USPC ..... 114/345, 68, 69, 360; 441/40–42; 206/0.6
See application file for complete search history.

(56) References Cited

U.S. PATENT DOCUMENTS

| | | | | | |
|---|---|---|---|---|---|
| 2,485,898 | A | * | 10/1949 | Mathews et al. | 249/65 |
| 2,494,316 | A | * | 1/1950 | Sanderson | 114/292 |
| 2,627,077 | A | * | 2/1953 | Forsyth | 267/117 |
| 2,644,449 | A | * | 7/1953 | Champagne | 128/118.1 |
| 2,744,267 | A | * | 5/1956 | Roby | 440/113 |
| 3,559,222 | A | * | 2/1971 | Walker | 114/357 |
| 4,253,209 | A | * | 3/1981 | Carn | 114/39.14 |
| 5,687,664 | A | * | 11/1997 | Sofian | 114/61.25 |
| 5,732,650 | A | | 3/1998 | Peterson | |
| 6,352,460 | B1 | * | 3/2002 | Eiband et al. | 441/80 |
| 6,860,220 | B2 | * | 3/2005 | Fleming | 114/345 |
| 7,421,968 | B1 | | 9/2008 | Hu | |

FOREIGN PATENT DOCUMENTS

| | | | | |
|---|---|---|---|---|
| FR | 2858802 A1 | * | 2/2005 | B63B 35/73 |
| KR | 10-2007-0089388 | | 8/2007 | |

OTHER PUBLICATIONS

International Search Report—PCT/KR2009/003770 dated Feb. 22, 2010.

* cited by examiner

*Primary Examiner* — Ajay Vasudeva
(74) *Attorney, Agent, or Firm* — Cantor Colburn LLP

(57) ABSTRACT

A gas-containing unit and a water vehicle including the same are disclosed. The gas-containing unit includes a pair of reinforcement boards that are positioned in line with each other, a tube member that is positioned between the reinforcement boards and is capable of gas injection, and a support frame that is furnished along the outer circumference of the pair of reinforcement boards to connect the pair of reinforcement boards to each other. It is possible to prevent damage such as scratching and tearing of a soft tube material due to external shock, and to improve overall structural strength.

14 Claims, 6 Drawing Sheets

BUILT-IN GAS UNIT AND AQUATIC TRANSPORTATION EQUIPMENT INCLUDING THE SAME

TECHNICAL FIELD

The present invention relates to a gas-containing unit and a water vehicle including the same, and more particularly, to a structure of a gas-containing unit that is designed to withstand external impact and exhibit improved overall structural strength.

BACKGROUND ART

In general, a tube has a volume that is variably set depending on whether or not gas is injected, and is used to float an object in the water due to its low specific gravity. Such a tube is used as a buoyant body in a water vehicle, such as a small boat, since it is relatively light and easy to carry.

The tube is generally made of a soft material, such as Polyvinyl Chloride (PVC), polyurethane, or the like. Thus, the tube, which is used as a buoyant body of a water vehicle such as a boat, is vulnerable to damage, such as scratching or tearing, when the water vehicle collides against a sharp object, such as a rock or a coral reef, thereby endangering people in the water vehicle.

DISCLOSURE

Technical Problem

An object of the invention is to provide a gas-containing unit that can prevent a tube member, which is made of a soft material, from being scratched or torn by external impact and exhibit improved overall structural strength, and a water vehicle including the same.

Advantageous Effects

According to embodiments of the invention, a structure in which a pair of reinforcement boards protects a tube member, which is disposed between the reinforcement boards, is provided. This structure can prevent the tube member, which is made of a soft material, from being damaged, for example, being scratched or torn by external impact, as well as exhibit improved overall structural strength.

In addition, a pair of the reinforcement boards can be uniformly inflated without being partially crushed, since a support frame stably supports the outer circumference of a pair of the reinforcement boards while a pair of the reinforcement boards are is inflated along with the tube member as gas is being injected into the tube member.

Furthermore, since the reinforcement boards are in the form of a flat plank when gas is not injected into the tube member, it is possible to improve the ease with which the gas-containing unit can be carried and maintained.

BEST MODE

Figure 1:
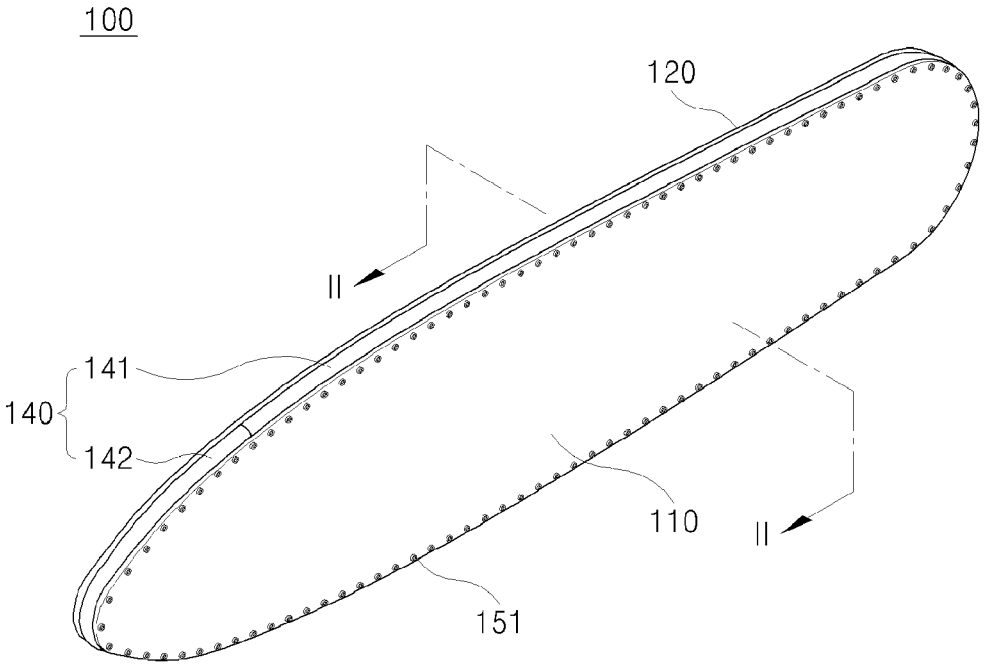
FIG. 1 is a perspective view of a gas-containing unit according to an exemplary embodiment of the invention.

According to the invention for realizing the foregoing object, the gas-containing unit includes a pair of reinforcement boards, which are disposed parallel to each other; a tube member disposed between the reinforcement boards, the tube member is shaped such that gas can be injected thereinto; and a support frame provided along the outer circumference of a pair of the reinforcement boards to connect the reinforcement boards to each other.

In the gas-containing unit, a pair of the reinforcement boards may have a plank-like shape when gas is not injected into the tube member, and be inflated along with the tube member when gas is injected into the tube member, thereby being transformed into a shape that bulges outwards.

The gas-containing unit may further include fastening members, which fasten the reinforcement boards to the support frame.

A pair of the reinforcement boards may be coupled to the support frame using thermal fusion. The reinforcement boards may be made of engineering plastic. The reinforcement boards may have a streamlined structure, with a width thereof decreasing from the central portion to both ends.

The support frame may be configured to be substantially identical with the outline of the reinforcement boards. The support frame may include at least one pipe having a circular cross section.

The pipe may be made of engineering plastic. The pipe may include a buoyant member, which fills the inside thereof. The buoyant member may be made of polystyrene foam. The at least one pipe may include a plurality of pipes, which are coupled to each other.

A plurality of the pipes may include a first pipe and a second pipe detachably coupled to the first pipe. The second pipe has a length that is shorter than that of the first pipe. The first and second pipes may have a streamlined overall structure.

The support frame may further include a coupling pipe, which is fitted into the second pipe. Both ends of the coupling pipe protrude from both ends of the second pipe, and are fitted into both ends of the first pipe, thereby coupling the first pipe to the second pipe.

A pair of the reinforcement boards may be configured such that that it bulges outwards when gas is not injected into the tube member. The boards may be made of metal.

According to the invention for realizing the foregoing object, the water vehicle includes the gas-containing unit having the above-described configuration.

MODE FOR INVENTION

The above and other advantages of the invention and of the operation of the invention and the above and other objects, which are realized by embodying the invention, will be more apparent from the following description taken in conjunction with the accompanying drawings, which show exemplary embodiments of the invention.

The present invention will now be described more fully hereinafter with reference to the accompanying drawings, in which exemplary embodiments thereof are shown. In the following description of the present invention, however, detailed descriptions of known functions and components incorporated herein will be omitted when they may make the subject matter of the present invention unclear.

Figure 2:
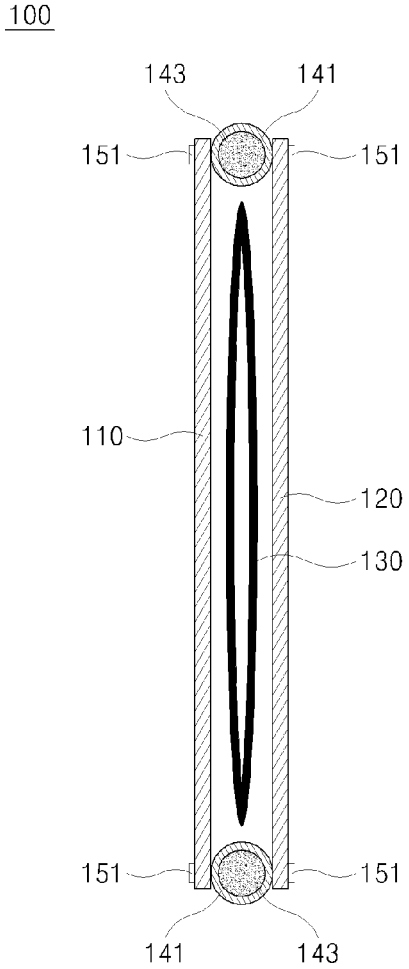
FIG. 2 is a cross-sectional view of the gas-containing unit taken along line II-II in FIG. 1.
Figure 3:
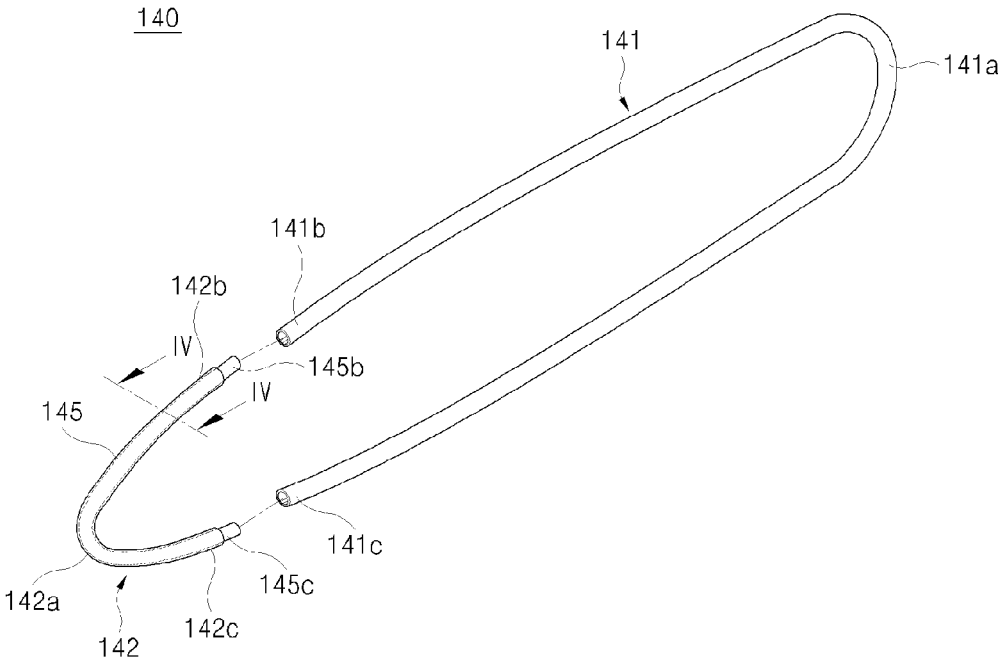
FIG. 3 is a perspective view of the support frame of the gas-containing unit shown in FIG. 1.
Figure 4:
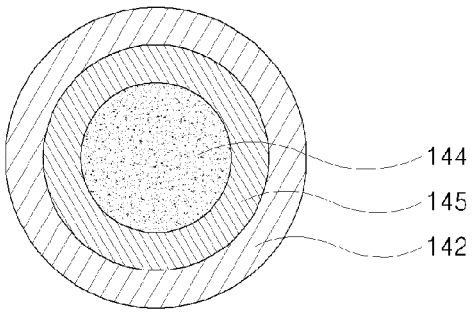
FIG. 4 is a cross-sectional view of the support frame taken along line IV-IV in FIG. 3.

FIG. 1 is a perspective view of a gas-containing unit according to an exemplary embodiment of the invention, FIG. 2 is a cross-sectional view of the gas-containing unit taken along line II-II in FIG. 1, FIG. 3 is a perspective view of the support frame of the gas-containing unit shown in FIG. 1, and FIG. 4 is a cross-sectional view of the support frame taken along line IV-IV in FIG. 3.

Referring to FIGS. 1 and 2, the gas-containing unit 100 of this embodiment is a buoyant body that is used to float a water vehicle, such as a boat, in the water. The gas-containing unit 100 includes a pair of reinforcement boards 110 and 120, the reinforcement boards 110 and 120 disposed parallel to each other; a tube member 130, which is disposed between the reinforcement boards 110 and 120 and is configured such that gas can be injected thereinto; and a support frame 140, which is provided along the outer circumference of the reinforcement board 110 and 120 in order to connect the reinforcement boards 110 and 120 to each other.

The reinforcement boards 110 and 120 are in the form of a flat plank, which has a streamlined structure in which the width decreases from the center to both ends thereof. In addition, the reinforcement boards 110 and 120 are configured such that the front end is more sharply pointed than the rear end, since the curvature of the front end is smaller than that of the rear end. However, the structure of the reinforcement boards 110 and 120 are not limited to this streamlined structure, but can suitably vary according to the aspect in which the gas-containing unit 100 is applied. For example, the reinforcement boards 110 and 120 can be in the form of a rectangular plank.

The reinforcement boards 110 and 120 are means for protecting the tube member 130, which is disposed between thereof, while reinforcing the overall structural strength of the gas-containing unit 100. The reinforcement boards 110 and 120 are made of engineering plastic, which has excellent mechanical strength, abrasion resistance, thermal resistance, and the like. The engineering plastic is a type of high-strength plastic used as an industrial or structural material, and refers to high-performance resin having a high molecular structure, which is stronger than steel, more ductile than aluminum, and more chemically resistant than gold and silver. Alternatively, the reinforcement boards 110 and 120 can be made of general plastic or metal, such as stainless steel (SUS). However, the reinforcement boards 110 and 120 are required to be inflated along with the tube member 130 when gas is injected into the tube member 130 so that it is transformed into a shape that bulges outwards (see FIGS. 5 and 6), and this fact should be considered when determining the material and the thickness of the reinforcement boards 110 and 120.

The tube member 130 is contained in the inner space, which is defined by the reinforcement boards 110 and 120 and the support frame 140. The tube member 130 can be made of a variety of soft materials, such as Polyvinyl Chloride (PVC), urethane vinyl, synthetic resin, and the like. The tube member 130 can be provided in a single ply or a plurality of plies. The tube member 130 is provided with a gas inlet, through which gas can be injected into the tube member 130. The tube member 130 is configured such that it is inflated to maintain a predetermined inner volume when gas is injected into the tube member 130 through the gas inlet. The tube member 130 can be selected from well-known tubes having a variety of structures. An inlet opening, which exposes the gas inlet of the tube member 130 to the outside, is formed in the portion of the reinforcement boards 110 and 120 that is adjacent to the gas inlet of the tube member 130. Although not shown in the figures, a stopper or a cover, which opens and closes the inlet opening, can be provided to the portion of the reinforcement boards 110 and 120 in which the inlet opening is formed.

Although one tube member 130 is provided between the reinforcement boards 110 and 120 in this embodiment, the present invention is not limited thereto. Rather, a plurality of the tube members 130 can be provided between the reinforcement boards 110 and 120. For example, two tube members 130 can be arranged vertically at upper and lower positions between the reinforcement boards 110 and 120, or three tube members 130 can be arranged in a triangular arrangement between the reinforcement boards 110 and 120. In the case in which a plurality of the tube members 130 is provided as above, it is preferred that a partition or partitions (not shown), which divide a space for containing one tube member 130 from the remaining spaces, be provided between the reinforcement boards 110 and 120.

Referring to FIGS. 1 to 4, the support frame 140 is configured to substantially correspond to the outline of a pair of the reinforcement boards 110 and 120. In this embodiment, a pair of the reinforcement boards 110 and 120 has a streamlined structure, and thus the support frame 140 is also configured such that it has a streamlined overall structure. The support frame 140 functions to maintain the stability of the overall structure of the gas-containing unit 100 while forming the skeleton of the gas-containing unit 100. In particular, the support frame 140 stably supports the outer circumference of a pair of the reinforcement boards 110 and 120 while a pair of the reinforcement boards 110 and 120 is being inflated along with the tube member 130, so that a pair of the reinforcement boards 110 and 120 can be uniformly inflated without being partially crushed.

In this embodiment, the support frame 140 is fabricated by bending two pipes 141 and 142 (i.e. a long pipe and a short pipe) by applying a certain amount of heat thereto, followed by coupling the pipes 141 and 142 to each other. That is, in this embodiment, the support frame 140 includes the two pipes 141 and 142 coupled to each other, each of which has a curved portion. Each of the two pipes 141 and 142 is a pipe having a circular cross section, which is made of engineering plastic. The inside of the two pipes 141 and 142 is filled with pieces of polystyrene foam 143 and 144, which form buoyant members. The pieces of polystyrene foam 143 and 144 serve to increase the buoyancy of the gas-containing unit 100 as well as to prevent water from permeating into the pipes.

The longer pipe (hereinafter, referred to as a "first pipe") of the two pipes 141 and 142 has a curved portion 141*a* having a curvature the same as that of the rear end of a pair of the reinforcement boards 110 and 120, and the short pipe (hereinafter, referred to as a "short pipe") has a curved portion 142*a* having a curvature the same as that of the front end of a pair of the reinforcement boards 110 and 120.

In addition, the support frame 140 also includes a coupling pipe 145 that couples the second pipe 142 to the first pipe 141. The coupling pipe 145 is fitted into the second pipe 142, with both ends 142*b* and 145*c* thereof protruding from both ends 142*b* and 142*c* of the second pipe 142. The coupling pipe 145 has a shape that is substantially the same as that of the second pipe 142, with the outer diameter thereof being slightly smaller than the inner diameter of the second pipe 142 such that the coupling pipe 145 can be fitted into the second pipe 142, and with the length thereof being slightly longer than that of the second pipe 142 such that the both ends 145 and 145*c* of the coupling pipe 145 can protrude from the both ends 142*b* and 142*c* of the second pipe 142. Then, by fitting the both protruding ends 145*b* and 145*c* of the coupling pipe 145 into both ends 141*b* and 141*c* of the first pipe 141, the first and second pipes 141 and 142 are coupled to each other. However, the coupling between the first and second pipes 141 and 142 is not limited to the above-described method of this embodiment, but can be realized using any one of well-known methods.

As above, since the support frame 140 includes the long first pipe 141 and the short second pipe 142, which are coupled to each other, it is possible to open the front end of a pair of the reinforcement boards 110 and 120 by decoupling the second pipe 142 from the first pipe 141, and then replace the tube member 130, which is provided between the reinforcement boards 110 and 120, with a new tube member. Accordingly, when the tube member 130, which is provided between the reinforcement boards 110 and 120, is broken and its replacement is required, it is possible to replace the tube member 130 without disassembling the gas-containing unit, thereby increasing convenience in replacement of the tube member 130.

Unlike this embodiment, the support frame 140 can be fabricated integrally by bending a single pipe, or be fabricated by bending three or more pipes, followed by coupling the pipes to each other. In addition, the pipes that constitute the support frame 140 can be made of a material rather than the above-described plastic material. For example, the pipes can be made of a general plastic material, or a metal material, such as stainless steel (SUS). Furthermore, the support frame 140 is not limited to being constructed of the pipes, but the support frame 140 can be constructed of a solid bar or an angle having a C-shaped cross section. However, according to a number of experiments, it is preferred that the support frame 140 be constructed of a pipe having a circular cross section in terms of bending processability, overall structural stability, etc.

Referring to FIGS. 1 and 2, the gas-containing unit 100 of this embodiment includes a plurality of rivets 151 as fastening members, which fasten a pair of the reinforcement boards 110 and 120 to the support frame 140. That is, in this embodiment, a pair of the reinforcement boards 110 and 120 is fastened to the support frame 140 by rivet fastening. A plurality of rivets 151 are arranged along the outer circumference of a pair of the reinforcement boards 110 and 120 at predetermined intervals. The number of the rivets 151, which are used, is suitably determined in consideration of the size of the gas-containing unit 100 and the properties of the material of the reinforcement boards 110 and 120 and the support frame 140.

In the meantime, when it is required to replace the tube member 130 as described above, the rivets 151 are unfastened from the second pipe 142 in order to separate the second pipe 142, which constitutes the support frame 140, from a pair of the reinforcement boards 110 and 120. When the replacement of the tube member 130 is completed, the second pipe 142 is coupled again to a pair of the reinforcement boards 110 and 120 using the rivets 151. Here, since the coupling pipe 145, which is made of a metal material such as aluminum, is fitted into the second pipe 142, which is made of a plastic material, no problem occurs even if the processing of unfastening the rivets 151 and refastening the rivets is repeated several times. Thus, the coupling pipe 145 functions to couple the first and second pipes 141 and 142 to each other as well as to enhance endurance against repeated riveting.

Although a plurality of the rivets 151 is illustrated in this embodiment as the fastening members for fastening a pair of the reinforcement boards 110 and 120 to the support frame 140, the present invention is not limited thereto. The method of fastening a pair of the reinforcement boards 110 and 120 to the support frame 140 can be realized using any one of a variety of methods, including bolt fastening. For reference, the bolt fastening is advantageous in that disassembling is easy, but bolts may be unfastened due to external impact or the like. Therefore, the rivet fastening is more preferable in the aspect of ensuring the overall structural strength of the gas-containing unit 100.

Furthermore, in the invention, it is possible to couple a pair of the reinforcement boards 110 and 120 to the support frame 140 without additional fastening members, such as the above-described rivets or bolts. For example, in the case in which thermal fusion is applied, it is preferred that both a pair of the reinforcement boards 110 and 120 and the support frame 140 be made of a plastic material.

Figure 5:
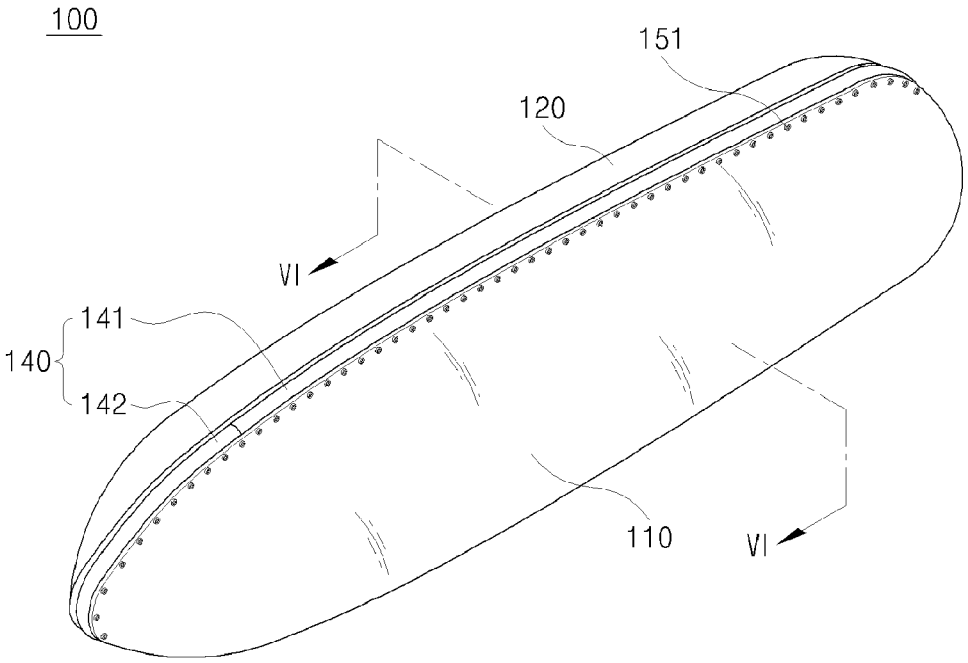
FIG. 5 is a perspective view of the gas-containing unit shown in FIG. 1, in which gas is injected into the tube member.
Figure 6:
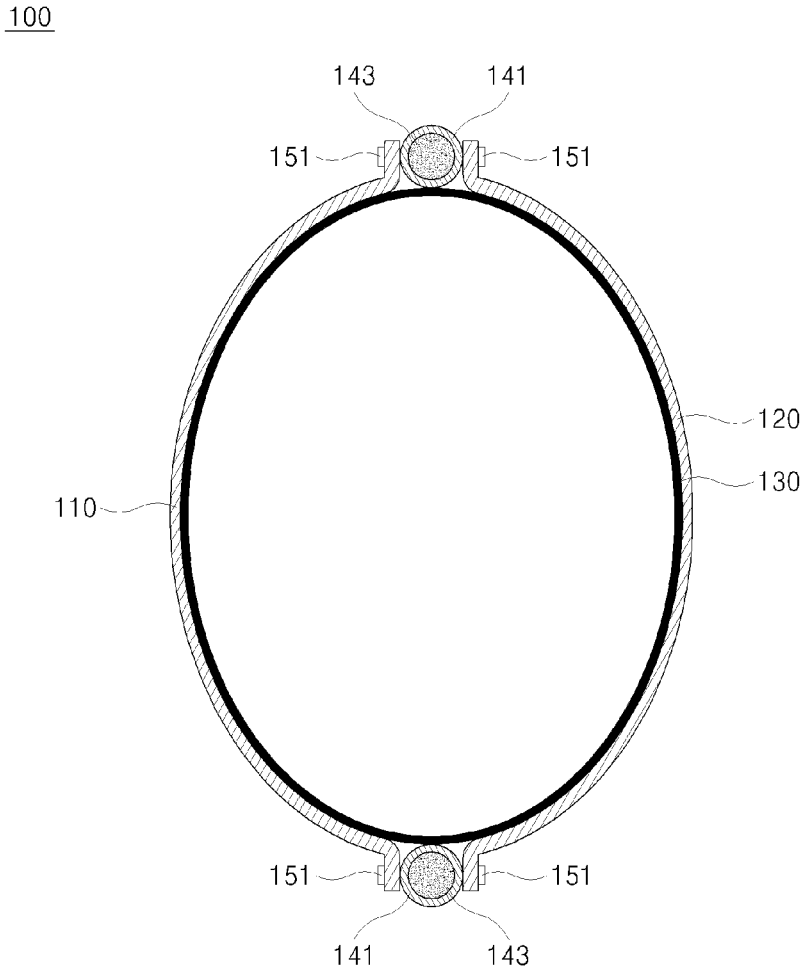
FIG. 6 is a cross-sectional view of the gas-containing unit taken along line VI-VI in FIG. 5.

FIG. 5 is a perspective view of the gas-containing unit 100 shown in FIG. 1 in which gas is injected into the tube member 130, and FIG. 6 is a cross-sectional view of the gas-containing unit 100 taken along line VI-VI in FIG. 5.

Referring to FIGS. 5 and 6, as gas is injected into the tube member 130, a pair of the reinforcement boards 110 and 120 is inflated along with the tube member 130, thereby having a shape that bulges outwards. That is, when gas is not injected into the tube member 130, a pair of the reinforcement boards 110 and 120 is in the form a substantially flat plank (see FIGS. 1 and 2). When the tube member 130 is inflated by injection of gas, a pair of the reinforcement boards 110 and 120 is pressed by the inflating tube member 130 so that it is transformed into a shape that bulges outwards. Here, since a pair of the reinforcement boards 110 and 120 is stably supported by the support frame 140, it can be uniformly inflated along with the tube member 130 without being partially crushed, thereby obtaining an intended shape, for example, a smooth streamline shape. In addition, since the inner surface of a pair of the reinforcement boards 110 and 120 is pressed by the tube member 130, its structural strength against external impact is further enhanced.

In this embodiment, a pair of the reinforcement boards 110 and 120 is configured such that it is in the form of a substantially flat plank when gas is not injected into the tube member but is inflated along with the tube member 130, thereby having a shape that bulges outwards, when gas is injected into the tube member 130. Alternatively, a pair of the reinforcement boards 110 and 120 is configured such that it has a shape that bulges outwards even when gas if not injected into the tube member 130. In this case, each of the reinforcement boards 110 and 120 can be manufactured by pressing a flat plank so that it has a curved shape that bulges in one direction.

As described above, the gas-containing unit 100 of this embodiment can prevent the tube member 130, which is made of a soft material, from being damaged, for example, being scratched or torn by external impact as well as exhibit improved overall structural strength, since the tube member 130 is disposed between the reinforcement boards 110 and 120 such that a pair of the reinforcement boards 110 and 120 protects the tube member 130.

In addition, in the gas-containing unit 100 of this embodiment, a pair of the reinforcement boards 110 and 120 can be uniformly inflated without being partially crushed, since the support frame 140 stably supports the outer circumference of a pair of the reinforcement boards 110 and 120 while a pair of the reinforcement boards 110 and 120 is being inflated along with the tube member 130 as gas is being injected into the tube member 130.

Furthermore, in the gas-containing unit 100 of this embodiment, it is possible to improve the ease with which the gas-containing unit 100 can be carried and maintained, since a pair of the reinforcement boards 110 and 120 is in the form of a flat plank when gas is not injected into the tube member 130.

Figure 7:
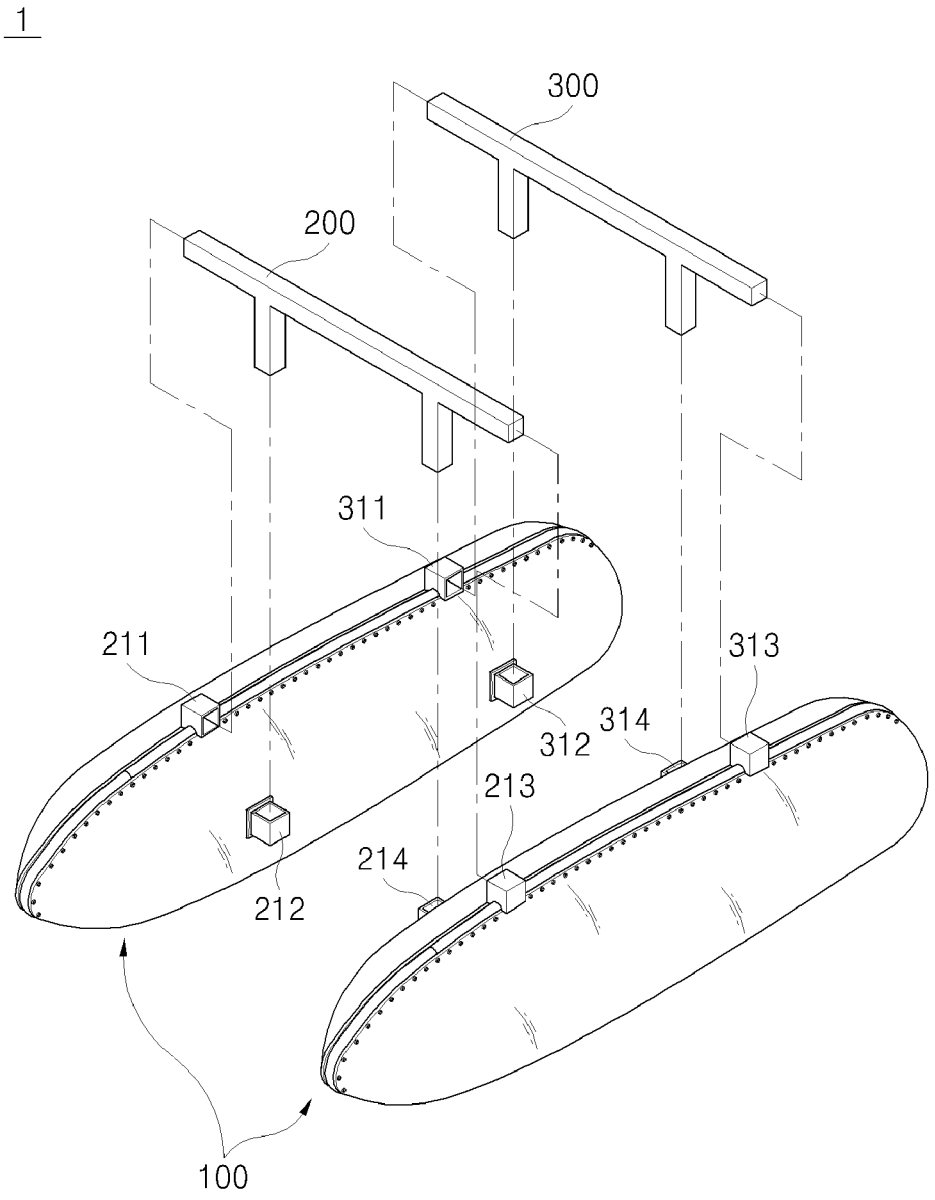
FIG. 7 is a schematic perspective view of a boat that serves as a water vehicle, which incorporates a gas-containing unit according to an exemplary embodiment of the invention.

FIG. 7 is a schematic perspective view of a boat that serves as a water vehicle, which incorporates a gas-containing unit according to an exemplary embodiment of the invention.

Referring to FIG. 7, the boat 1 of this embodiment includes a pair of the gas-containing units 100. The gas-containing units 100 are disposed parallel to each other to maintain a predetermined interval in the lateral direction. First and second structures 200 and 300 couple the gas-containing units 100 to each other. A deck (not shown) is mounted on the upper portion of the first and second structures 200 and 300 to provide a boarding area. Here, a pair of the gas-containing unit 100 is provided with first 4 binding members 211 to 214 to which ends of the first structure 200 are fitted and bound and second 4 binding members 311 to 314 to which ends of the second structure 300 are fitted and bound.

The gas-containing unit of the invention can of course be applied as a buoyant body not only to the above-described boat, but also to other water vehicles (e.g. a raft). Furthermore, the gas-containing unit of the invention can be applied to a water installation, such as a float or a water tent, which is installed near the dock.

The present invention is not limited to the foregoing embodiments, but various modifications and alterations will be apparent to a person having ordinary skill in the art without departing from the spirit and scope of the invention. Therefore, it should be understood that all such modifications and alterations fall within the scope of the claims of the invention.

INDUSTRIAL APPLICABILITY

The present invention is applicable to the technical field of a water vehicle including a boat.

The invention claimed is:

1. A gas-containing unit comprising:

a pair of reinforcement boards, wherein the reinforcement boards are disposed parallel to each other;

a tube member disposed between the reinforcement boards, wherein the tube member is configured such that gas is injected thereinto; and a support frame disposed between the reinforcement boards and extended along entire outer circumferences of the reinforcement boards to connect the reinforcement boards to each other, wherein the support frame includes a plurality of pipes each having a circular cross section and being coupled to each other.

2. The gas-containing unit according to claim 1, wherein the pair of the reinforcement boards has a plank-like shape when gas is not injected into the tube member, and is inflated along with the tube member when gas is injected into the tube member, thereby being transformed into a shape that bulges outwards.

3. The gas-containing unit according to claim 1, further comprising fastening members, which fasten the reinforcement boards to the support frame.

4. The gas-containing unit according to claim 1, wherein the pair of the reinforcement boards is coupled to the support frame using thermal fusion.

5. The gas-containing unit according to claim 1, wherein the reinforcement boards are made of engineering plastic.

6. The gas-containing unit according to claim 1, wherein the reinforcement boards have a streamlined structure, with a width thereof decreasing from a central portion to both ends.

7. The gas-containing unit according to claim 1, wherein the support frame is configured to be substantially identical with an outline of the reinforcement boards.

8. The gas-containing unit according to claim 1, wherein the pipes are made of engineering plastic.

9. The gas-containing unit according to claim 1, wherein the support frame includes a buoyant member, which fills an inside thereof, wherein the buoyant member comprises polystyrene foam.

10. The gas-containing unit according claim 1, wherein the plurality of the pipes include:

a first pipe; and a second pipe detachably coupled to the first pipe, wherein the second pipe has a length that is shorter than that of the first pipe.

11. The gas-containing unit according to claim 10, wherein the first and second pipes have a streamlined overall structure.

12. The gas-containing unit according to claim 10, wherein the support frame further includes a coupling pipe, which is fitted into the second pipe, wherein both ends of the coupling pipe protrude from both ends of the second pipe, and are fitted into both ends of the first pipe, thereby coupling the first pipe to the second pipe.

13. The gas-containing unit according to claim 1, wherein the boards are made of metal.

14. A water vehicle comprising the gas-containing unit described in claim 1.

* * * * *